US005845334A

United States Patent [19]

Marcolini, Jr.

[11] Patent Number: 5,845,334

[45] Date of Patent: Dec. 8, 1998

[54] KIT WEAR COMBINATION SPORTS APPAREL

[76] Inventor: John Anthony Marcolini, Jr., South Fayette Municaple Bld. Millers Run Road, McDonald, Pa. 15057

[21] Appl. No.: 845,824

[22] Filed: Apr. 28, 1997

[51] Int. Cl.[6] ..... A42B 1/00; A41D 1/00

[52] U.S. Cl. ..... 2/69; 2/69; 2/115; 2/170

[58] Field of Search ..... 2/69, 115, 227, 2/228, 108, 244, 246, 170; 40/586

[56] References Cited

U.S. PATENT DOCUMENTS

| | | | |
|---|---|---|---|
| 2,527,258 | 10/1950 | Kahn | 2/115 |
| 3,077,690 | 2/1963 | Feldman | 40/329 |
| 4,354,282 | 10/1982 | Langdon | 2/115 |
| 4,776,043 | 10/1988 | Coleman | 40/329 |
| 5,052,056 | 10/1991 | Braun | 2/115 |
| 5,136,726 | 8/1992 | Kellin et al. | 2/115 |
| 5,253,368 | 10/1993 | Blake | 40/329 |
| 5,359,734 | 11/1994 | Rathburn | 40/329 |

*Primary Examiner*—Gloria M. Hale

[57] ABSTRACT

Sportswear design that would allow the individual to interchange an array of decorative patches having hook and loop fastener material similar to the material sold under the trademark VELCRO onto garments. Patches could be changed daily. Combination sportswear consists of hats, coats, and gym bags. Patches would adhere to the sportswear by pressing hook and loop fastener components together. By using professional and college logos, the wearer can create a plurality of different allegiance toward his or her sports teams. Every team has specific colors. In order to know what color sports apparel you want to purchase, you first must decide on a team that you want to represent. If an individual chooses to support Pittsburgh teams, he or she would choose black or gold combination sports apparel then could purchase the Steeler, Pirate, and Penguin kits. By having one coat, you can support three teams. Also, other teams such as the San Diego Chargers, Oakland Raiders, etc. will also have the logo patches available for purchase. The combination sports apparel can create a plurality of different wearable styles.

REFERENCES CITED
U.S. PATENT DOCUMENTS

| | | |
|---|---|---|
| 4,354,282 | 10/1982 | Langdon |
| 4,611,355 | 11/1984 | Galanto et al |
| 5,428,844 | 07/1995 | Dougherty |
| 297,066 | 08/1988 | Schonwetter et al |
| 5,373,586 | 12/1994 | Brosnan |
| 5,416,928 | 05/1995 | Koenig |

12 Claims, 6 Drawing Sheets

KIT WEAR COMBINATION SPORTS APPAREL

BACKGROUND OF THE INVENTION

This invention relates to a combination of sports apparel where the same decorative logos can be applied to the various types of sports apparel. The hook and loop fastener patches in accordance to the combination sports apparel are not patches that can be positioned anywhere on the garment. The two-sided hook and loop fastener components have a designated area where the patch is to be applied. The lower hook and loop fastener component is sewn in the garment, off-set lower than the material. So, there is actually a pocket that the top hook and loop fastener patch fits down into. Sports caps, jackets, and gym bags are more popular today than ever. Why spend money on three coats to show support for three different teams. The invention would provide the opportunity to support three teams using one coat. Actually, there is no limit to the amount of teams you can support with only one coat, hat, or gym bag. Remember, the lower hook and loop fastener component is embedded or off-set down below the hat, coat, or gym bag material. This pothole effect is the base for the hook and loop fastener patch that displays the logo of the individual's favorite team. The individual's favorite player number is displayed along with the logo of the team and the team name.

Several U.S. patents have addressed decorative wear for fashion, but none have addressed using two-sided hook and loop fastener where the lower hook and loop fastener component is embedded or off-set below the material's surface. The best way to describe the lower component being off-set is to picture a pothole. The logo will fill in the hole.

Some patents have addressed some but not all of the above needs.

1. Langdon U.S. Pat. No. 4,354,282 The structure Langdon discloses is different from the present invention. The written and illustrated description is not consistent with the pothole effect of the Velcro components off-set down below the garment's material.
2. Galanto et al U.S. Pat. No. 4,611,355 Structural differences are evident. The front of the hat is Velcro FIG. 1, where the present invention has specific areas where Velcro components are to be embedded.
3. Dougherty U.S. Pat. No. 5,428,844 The Dougherty patent, either taken alone or in combination with the Langdon or Galanto et al references, does not make obvious the present invention.
4. Brosnan U.S. Pat. No. 5,373,586 The Brosnan patent is less pertinent to the construction and design of the invention. FIG. 3 shows a triangular patch across the entire front of the hat.
5. Schonwetter et al U.S. Pat. No. 297,066 and Koenig U.S. Pat. No. 5,416,928 Neither Schonwetter nor Koenig discloses all of the features of the present invention.

SUMMARY

The concept of this invention is a modified combination jacket and coat with the major modification involving interchangeable emblems or patches that could be displayed on various locations on the jacket such as on the sleeves, chest area, etc. The emblems could include the logos of a wide array of sports teams. The invention would consist of the sports apparel having hook and loop fastener sewn at various locations on it. Accompanying the garment would be patches that would incorporate the corresponding section of hook and loop fastener. Thus, they would easily adhere to the jacket by pressing the hook and loop fastener components together. The invention would allow the wearer to change the appearance of his coat or jacket by changing the patch frequently, creating a new design. Since various designs would be interchanged upon this coat, the individual could create a wide array of looks with just on coat, hat, or gym bag. Therefore, the individual would not need a large collection of jackets to display his allegiance to various sports teams. The invention can be produced in a wide array of attractive colors, corresponding to the colors of the wearer's favorite teams.

Other appealing features of the invention would be its versatility, novelty, attractiveness, ability to allow the individual to interchange and create an array of looks, and a reasonable price. The major modification would involve the ability to attach various decorative emblems to different locations upon the coat in order to change its appearance. Thus, with this invention, the user could interchange the patches daily or weekly in order to change the appearance of the garment. This would allow the individual to interchange the patches according to the sporting event he was viewing. Therefore, if the individual was attending a football game in the afternoon, he could display his favorite team's logo. However, if he was watching a hockey game that night, the emblem could be changed easily. With this invention, the individual would not need a large collection of jackets. Instead, he could simply interchange an array of patches onto one jacket. By interchanging patches, an individual could appear to have a large collection of sports apparel. This could reduce the amount of money spent purchasing jackets as well as reducing the storage area needed for these garments.

This is the intended function and purpose of the invention and accomplished objectives desired of the invention.

The variations of the invention will make it more appealing to a wider range of users. This could include producing the sports apparel in an array of attractive colors as well as sizes for adults and children. Furthermore, it would be possible to produce the hook and loop fastener patch in a variety of sizes as well as with an array of designs or logos.

The sports apparel would be readily producible. The sports apparel would be a standard and readily available component. The physical form could feature a nylon or cotton shell, possibly from an array of materials including a cotton/polyester blend, leather, etc. The hook and loop fastener, snaps, zippers, or buttons would represent standard and readily available components. The primary market for the sports apparel would be individuals 6 years of age and older. According to the Department of the Interior, 40 percent of Americans age 12 and older had attended at least one outdoor sporting event during the year.

DETAILED DESCRIPTION OF PREFERRED EMBODIMENTS

Figure 1:
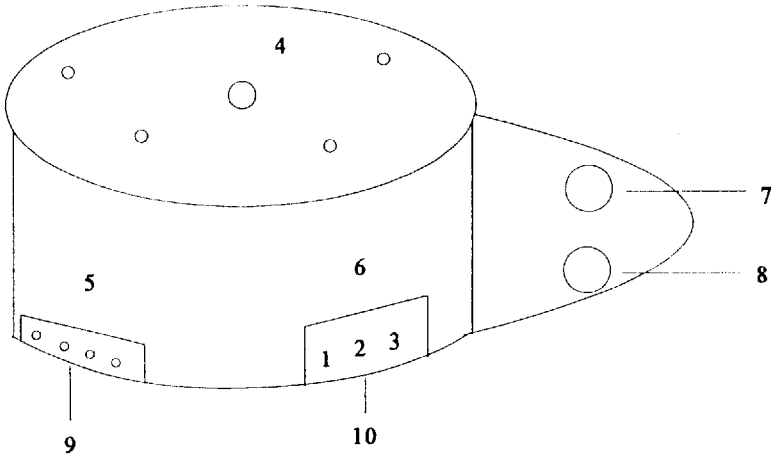
FIG. 1 is a side and back view of a baseball hat in accordance with the present invention, demonstrating the Velcro patch location.

Referring to figures of the drawings, starting with FIG. 1, Page 1 of 6, a baseball cap showing the top side 4, back of hat 5. This is a conventional-style baseball hat. There is an adjustable strap with plastic fasteners 9. There is a traditional-style brim with two hook and loop fastener patches 7 and 8 that are sewn into the brim of the hat off-set below the material. The logo patch will be applied on top of the conventional patch that is off-set below the material 7 and 8. On the right side of the hat, there will be a square hook and loop fastener component off-set below the material 10. Names of teams will be placed in this area 1, 2, and 3. The front view of the hat shows a larger round patch off-set below the material 11. This patch is the team's logo.

Referring back to FIG. 1, 7 and 8, a numerical patch is used advertising a player's number or favorite team record.

Figure 2:
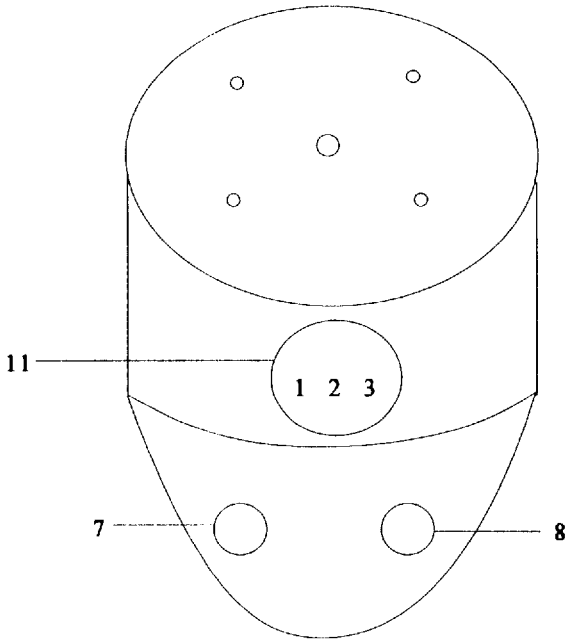
FIG. 2 is a front view of a baseball hat only, showing the emblem/symbol area above the brim, indicating numbers 1 through 3.
Figure 3:
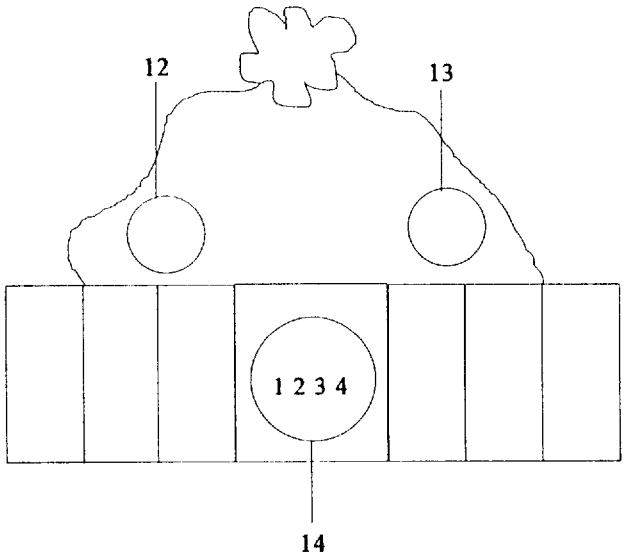
FIG. 3 is a side and back view of a ski cap in relationship to FIG. 1.
Figure 4:
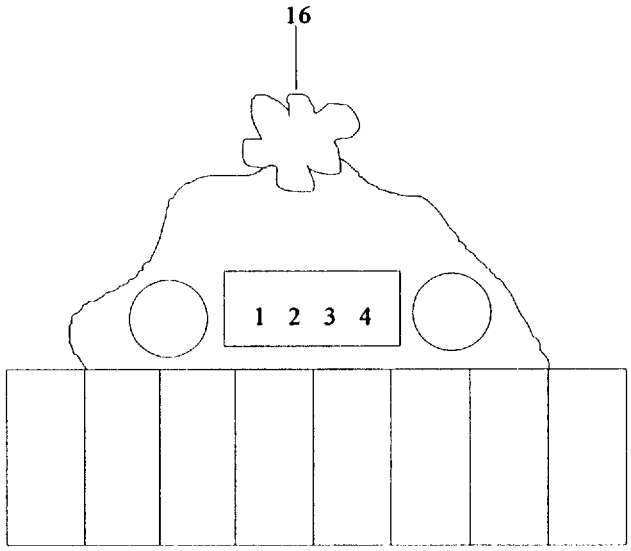
FIG. 4 is a side and back view of a ski cap in relationship to FIG. 2.

Referring to the drawings FIG. 3, Page 2 of 6, the drawing is of a conventional ski cap consisting of components similar to those of FIG. 1 and FIG. 2, Page 1. There are two hook and loop fastener patches sewn into the knit material of the ski cap 12 and 13. The hook and loop fastener components are off-set, as on the baseball caps Page 1. The front patch on the ski cap 14 will display a team's symbol, examples 1 through 4.

In this figure, the diagram we can explore in theory is the New York market, whose teams' colors are primarily blue. The hat, jacket, or bag would be blue along with the hook and loop fastener patch. See FIG. 2, showing several symbols and note 1, the New York Giants symbol. The hats' side and back view 12 and 13 are the same. The back of the hat will display the team's name. See FIG. 1 where the patch is to be placed. Variations to the hat's design can be implemented as desired. Various colors and tassels, 16, can be used. Team hook and loop fastener patches for baseball combination hats are interchangeable with team patches hook and loop fastener for ski caps and combination book bag/gym bag apparel.

Figure 5:
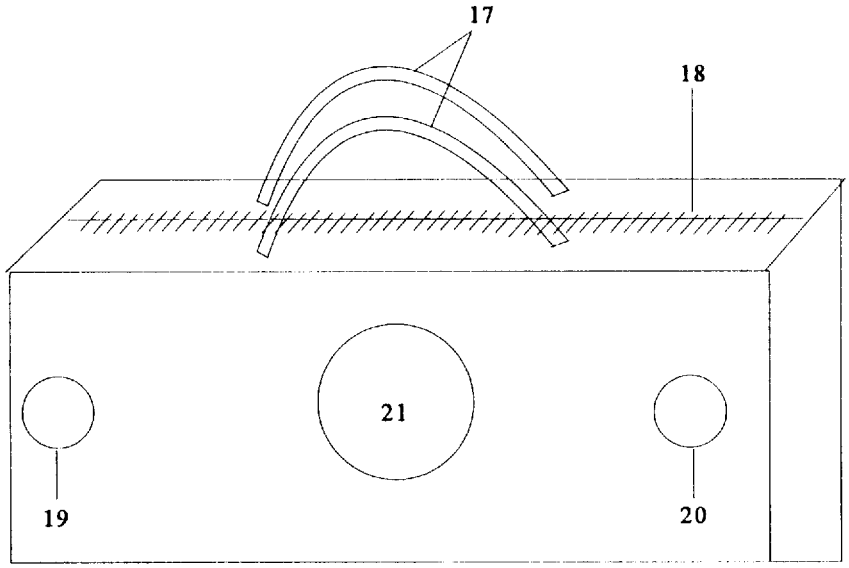
FIG. 5 is a perspective view of a combination school book bag and/or gym bag in relationship to using hook and loop fastener patches and emblems and FIG. 1–4.
Figure 6:
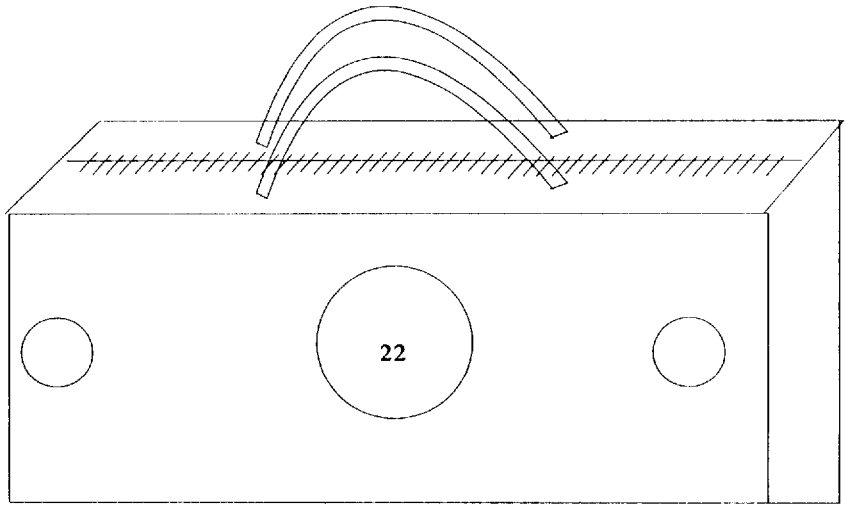
FIG. 6 is a perspective side view opposite FIG. 5 and in relationship to FIG. 2 and FIG. 4.

As shown in FIG. 5, Page 3 of 6, the bag is designed to be a combination book bag for school or a sports gym bag for athletics. This is a conventional-style bag consisting of two leather or vinyl handles 17. Bags will open and close using a zipper along with the invention's logo on it 18. Hook and loop fastener components will be off-set as in FIG. 1 through FIG. 4. The team emblem patch will be placed over the lower hook and loop fastener component that is off-set in the bag's material. Bags can be made of various materials such as nylon, cotton, and plastics 21. Favorite player numbers that represent the hook and loop fastener team logos can be placed on components 19 and 20. Another way to utilize components 19 and 20 is to display your favorite team's win and loss record, 19 representing wins and 20 representing losses. The team hook and loop fastener patches for the gym bag are interchangeable with team hook and loop fastener patches for baseball caps and ski tassel hats. Referring to FIG. 6, Side B, there is an example of several team names that can be used 22. The hook and loop fastener components will be off-set under the gym bag/book bag's material (leather, for example). Any one of the Pittsburgh teams, 1 through 3, will conform to a gold or black bag.

Figure 7:
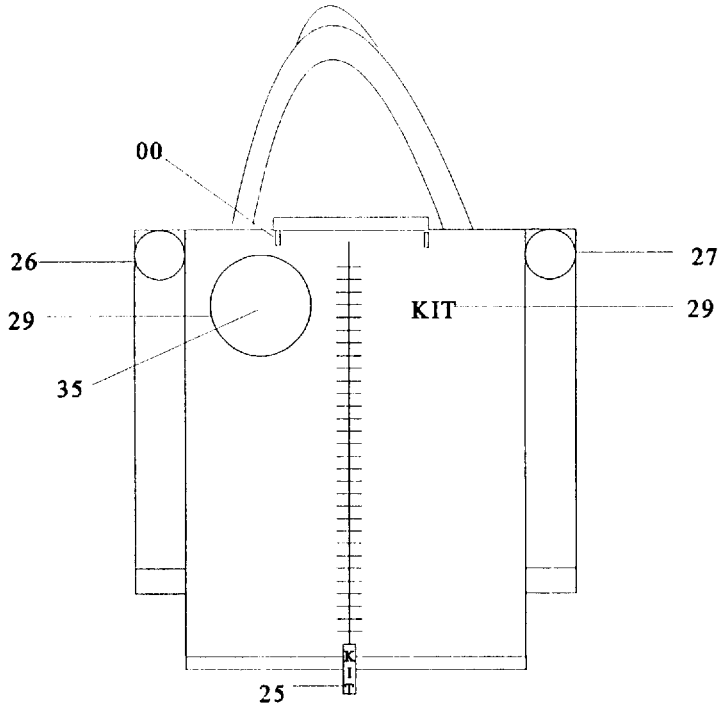
FIG. 7 is a front view of the invention utilizing coats and demonstrating symbol and arm patch locations.
Figure 8:
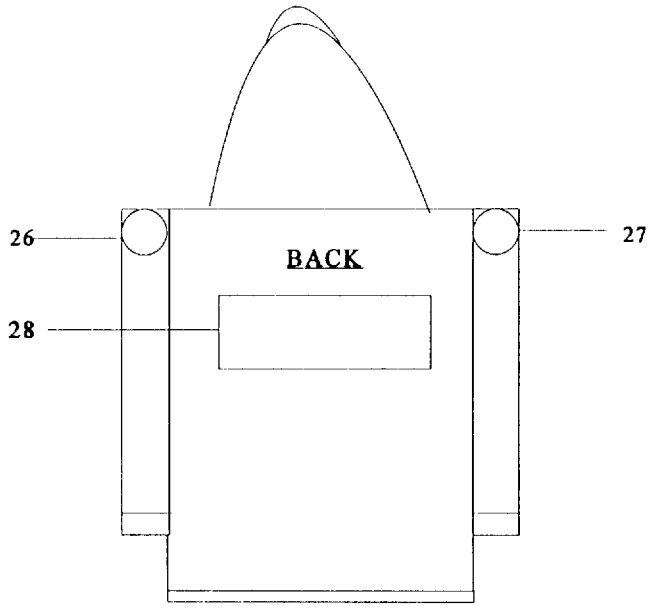
FIG. 8 is a back view of the invention showing the location of team patches in accordance to FIG. 7.

Referring to FIG. 7, Page 4 of 6, introducing the coat for winter, the combination coat for winter will be designed to have a large hood that can easily adjust to size by tightening strings which have plastic adjustments you can press and release (See FIG. 7, 00). This will only be available on the winter coat. The invention's name will be located on the front of the coat 29. The coat's zipper will also take into consideration the invention's name 25. Hook and loop fastener components will be inserted on both shoulders, left 26 and right 27. Referring to FIG. 8, there will be an oversized team hook and loop fastener patch that will attach to the hook and loop fastener component off-set into the coat 28. The team patches for the winter coat are interchangeable with hook and loop fastener team patches for the spring windbreaker.

Figure 9:
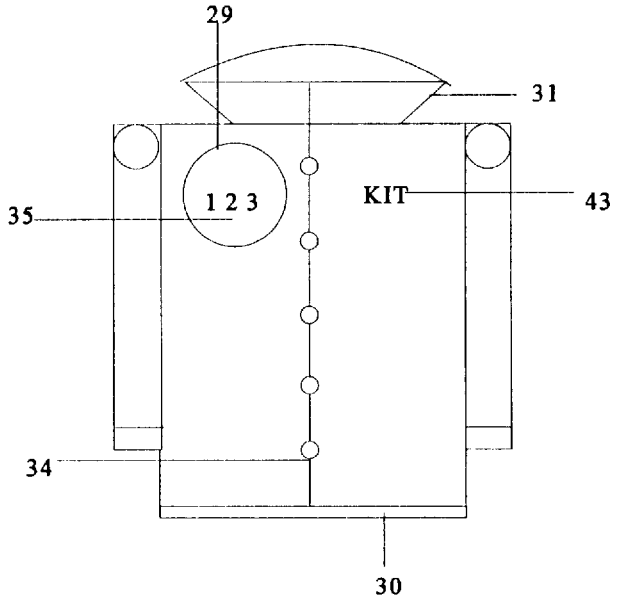
FIG. 9 is a revised drawing similar to FIG. 7 and FIG. 8 showing the collar and button snaps.
Figure 10:
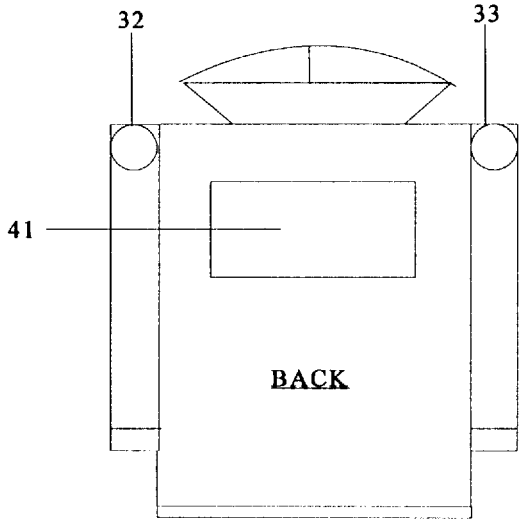
FIG. 10 is a back view of the invention focused on areas 1 through 3.

The hook and loop fastener packages for the spring windbreaker jacket FIG. 9 and FIG. 10, Page 5 of 6, also are consistent with the winter coat, using the same hook and loop fastener patches FIG. 7 and FIG. 8. The large hook and loop fastener component 29 is a round component and, when sewing, is off-set below the coat's material. The team name is another hook and loop fastener patch that is applied over the component sewn into the coat 35. All spring and winter coat packages are interchangeable. The coat in FIG. 9 can be worn while playing an activity on the sports field.

Figure 11:
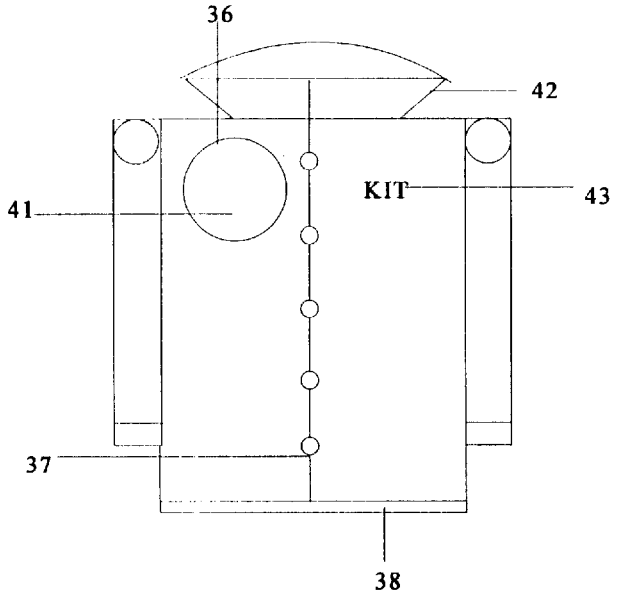
FIG. 11 is a drawing of items considered to be special-order sports apparel relating to schools, clubs, and leagues.
Figure 12:
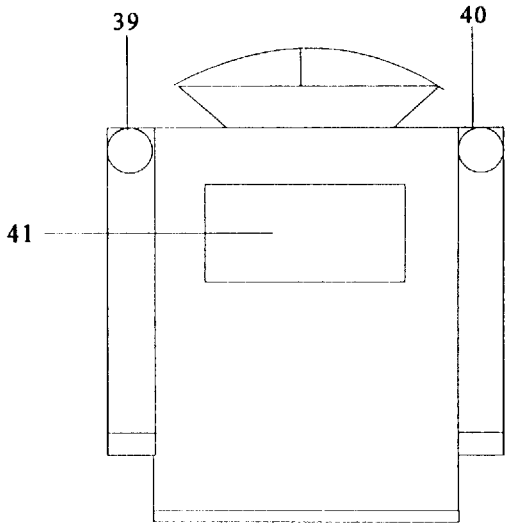
FIG. 12 is a back view of FIG. 11, taking into consideration all figures on sports apparel related to the present invention.

Referring to FIG. 11 and FIG. 12, Page 6 of 6, special-order combination coats for spring, FIG. 7 can also be special-order sports wear, apply to FIG. 11 pertaining to custom logos applied to all combination hats, coats, and bags. Special-ordered sports apparel applies only to the hook and loop fastener packages. This would be any special-order emblem hook and loop fastener patch or logo patch that a designer can commercialize. The hook and loop fastener patch component is off-set under the coat's material 36, displaying high school or little league logos. Colleges, bowling leagues, swim teams, billiard leagues, or coaching staff can display their various titles on the backs of their coats 41. The hook and loop fastener patch that represents the activity is placed over the lower hook and loop fastener component that is off-set into the jacket or winter coat. The coat's collar flips up for cold days on the playing field 42. The inside liner keeps the athlete or school student warm 38. The button snaps should contrast with the color of the coat 37. Coats, hats, and bags would display the school's color (for example, USC would be red). Player's numbers of team records can be displayed on the left shoulder 39 and right shoulder 40. The invention's name will be displayed as in 43, FIG. 9 and FIG. 11 on the coat chest area only and as in FIG. 7, chest area and zipper area 25.

Commercial hook and loop fastener is intended for the invention; low-grade hook and loop fastener is not recommended. If the logo patch is lost or stolen, the hook and loop fastener component should be consistent with the color of the sports apparel (for example, red hat, red hook and loop fastener; black hat, black hook and loop fastener). This concludes the numerical order for the present drawings.

What is claimed is a new concept and designed to be protected by Letters of Patent:

1. A article of apparel comprising:

(a) material forming the article of apparel and defining a recessed portion;

(b) hook and loop fastener material located in the recessed portion, the hook and loop fastener material fixedly attached to the apparel material, the hook and loop fastener material is sized and proportioned such that the surface of the hook and loop fastener material is off-set from the surface apparel material;

(c) at least one patch having a first material with indicia thereon and a second material being the corresponding hook and loop fastener material such that the patch hook and loop fastener material adheres to the hook and loop fastener material located in the cavity, the first material is fixedly attached to the second material and the first and second materials are sized and proportioned to fit within the cavity such that the first material is flush with the surface of the apparel material.

2. The apparel of claim 1, wherein the apparel is a hat.

3. The apparel of claim 2, wherein the hat is a knit ski hat.

4. The apparel of claim 2, wherein the hat is a baseball hat.

5. The apparel of claim 1, wherein the apparel is a bag.

6. The apparel of claim 1, wherein the apparel is a coat.

7. The apparel of claim 1, wherein the color of the article of apparel is the same as the patch.

8. The apparel of claim 1, wherein the apparel has a plurality of patches.

9. A kit for adapting the appearance of apparel comprising:

(a) at least one article of apparel comprising:

(i) material forming the at least one piece of apparel and defining at least one recessed portion;

(ii) hook and loop fastener material located in the at least one recessed portion, the hook and loop fastener material fixedly attached to the apparel material, the hook and loop fastener material is sized and proportioned such that the surface of the hook and loop fastener material is off-set from the apparel material;

(iii) a plurality of patches each having a first material with indicia thereon and a second material being the corresponding hook and loop fastener material such that the plurality of patches hook and loop fastener material adheres to the hook and loop fastener material located in the at least one recessed portion, the first material is fixedly attached to the second material and the first and second materials are sized and proportioned such that the first material is flush with the apparel material.

10. The kit according to claim 9, further comprising a plurality of recessed portions that are sized and proportioned to accept each of the plurality of patches.

11. The kit according to claim 9, further comprising a plurality of articles of apparel such that the plurality of patches can be adhered to any of the plurality of articles of apparel.

12. The kit according to claim 9, wherein the material of the article of apparel is the same color at the plurality of patches.

* * * * *